US006134771A

United States Patent [19]

Nakamura et al.

[11] Patent Number: 6,134,771

[45] Date of Patent: Oct. 24, 2000

[54] METHOD OF ENCASING LEADS OF AN ELECTRONIC PART

[75] Inventors: Toshikazu Nakamura; Takashi Shikama, both of Youkaichi, Japan

[73] Assignee: Murata Manufacturing Co., Ltd., Nagaokakyo, Japan

[21] Appl. No.: 08/775,303

[22] Filed: Dec. 31, 1996

Related U.S. Application Data

[62] Division of application No. 08/504,338, Jul. 19, 1995, abandoned.

[30] Foreign Application Priority Data

Jul. 19, 1994 [JP] Japan ..... 6-166884

[51] Int. Cl.[7] ..... H01R 43/16

[52] U.S. Cl. ..... 29/612; 29/874; 338/22 R; 338/273; 338/276

[58] Field of Search ..... 29/612, 610.1, 29/874; 338/22 R, 273, 274, 276, 322, 324, 334

[56] References Cited

U.S. PATENT DOCUMENTS

| | | | |
|---|---|---|---|
| 2,111,220 | 3/1938 | Megow . | |
| 2,830,698 | 4/1958 | Coda et al. . | |
| 3,102,248 | 8/1963 | Temple . | |
| 3,179,911 | 4/1965 | Schmitt . | |
| 3,205,465 | 9/1965 | Lambertson et al. . | |
| 3,225,321 | 12/1965 | Walter . | |
| 3,245,017 | 4/1966 | Russell . | |
| 3,646,404 | 2/1972 | Matsuo et al. . | |
| 3,742,118 | 6/1973 | Myhre et al. . | |
| 3,848,076 | 11/1974 | Greber . | |
| 3,889,362 | 6/1975 | Tyler . | |
| 4,004,688 | 1/1977 | Braden . | |
| 4,116,064 | 9/1978 | McGlynn . | |
| 4,164,067 | 8/1979 | Brandt et al. . | |
| 4,223,786 | 9/1980 | Hori . | |
| 4,382,246 | 5/1983 | HÅnsson et al. | 29/612 |
| 4,514,787 | 4/1985 | Kaneko et al. . | |
| 4,542,439 | 9/1985 | Dick . | |
| 4,708,885 | 11/1987 | Saito et al. | 427/58 |
| 4,757,600 | 7/1988 | Holcomb . | |
| 5,111,175 | 5/1992 | Sugiura et al. . | |
| 5,168,257 | 12/1992 | Frielinghaus . | |
| 5,213,417 | 5/1993 | Yamada et al. . | |
| 5,239,745 | 8/1993 | Hofsass . | |

FOREIGN PATENT DOCUMENTS

| | | |
|---|---|---|
| 2-285602 | 11/1990 | Japan . |

*Primary Examiner*—P. W. Echols
*Attorney, Agent, or Firm*—Burns, Doane, Swecker & Mathis, LLP

[57] ABSTRACT

An electronic part in which insulating tape is adhered to lead terminals which extend from an electronic part unit so that a pitch between the terminals can remain stable and constant. The insulating tape is adhered to portions of the lead terminals in a vicinity of the unit from both sides such that the tape is placed with the terminals therebetween.

19 Claims, 2 Drawing Sheets

Fig. 1(a)
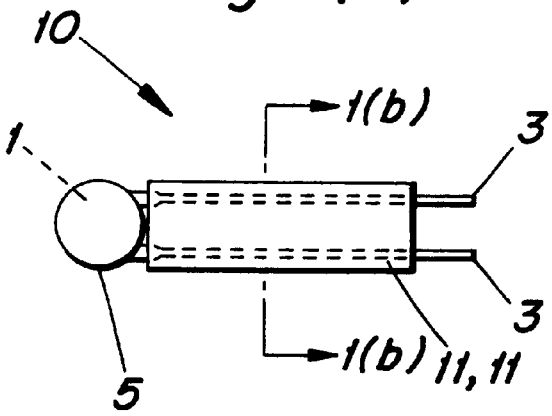
Fig. 1(b)
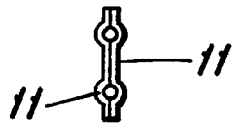
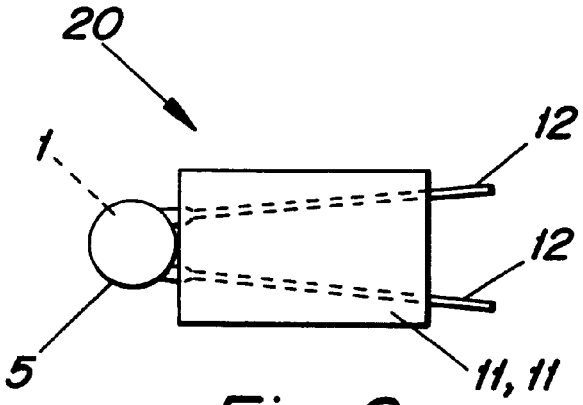
Fig. 2
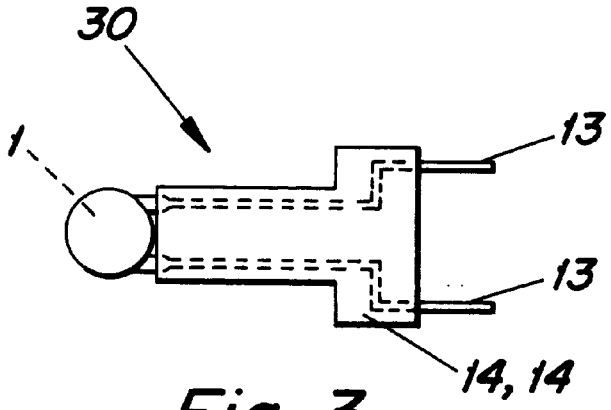
Fig. 3

METHOD OF ENCASING LEADS OF AN ELECTRONIC PART

This application is a divisional of application Ser. No. 08/504,338, filed Jul. 19, 1995 now abandoned.

BACKGROUND OF THE INVENTION

1. Field of the Invention

The present invention relates to a thermo-sensitive semiconductor device, such as positive and negative temperature coefficient thermistor devices or the like. More particularly, the invention relates to an electronic part having lead terminals connected to a thermo-sensitive semiconductor device which are coated in an insulating manner.

2. Description of the Related Art

An explanation will now be provided of a conventional electronic part having lead terminals which are coated in an insulating manner with reference to FIGS. 5–7.

As illustrated in FIG. 5, an electronic part having lead terminals which are coated in an insulating manner (hereinafter referred to as "insulation-coated lead terminals") is formed by the following process. Insulation-coated lead terminals 2, having both ends stripped of unnecessary insulating coatings, are directly connected by use of solder H or the like to an electronic part unit 1, i.e., a thermo-sensitive semiconductor device, such as a positive or negative temperature coefficient thermistor or the like. Then, the electronic element part unit 1 is coated in an insulating manner.

Alternatively, as shown in FIG. 6, a semi-finished product denoted by 5 comprising the electronic part element unit 1 which is coated in an insulating manner is obtained by the following process. Lead terminals 3 without insulating coatings (hereinafter simply referred to as "the lead terminals") are directly connected to the unit 1. The unit 1 and the portions of the lead terminals 3 adjacent to the unit 1 are immersed in a molten insulating coating 4. Subsequently, as shown in FIG. 7, insulating tubes 6 are fit around the lead terminals 3 of the semi-finished product 5, thereby obtaining an electronic part having the lead terminals which are thus coated in an insulating manner.

The electronic parts constructed as described above are formed by connecting the lead terminals 2 or 3 to the unit 1. The lead terminals 2 and 3 are insulated before or after the connecting operation, respectively.

However, the electronic parts provided with insulation-coated lead terminals constructed as described above encounter the following problems. It is difficult to strip the insulating coatings from the electronic parts, and also hard to connect the terminals to each of the electronic part element units. The formation of the lead terminals themselves is difficult. Additionally, a method of fitting the insulating tubes around the lead terminals increases the number of steps in the manufacturing process. It is also difficult to maintain the pitch of longer lead terminals constant.

SUMMARY OF THE INVENTION

Accordingly, in order to solve the above problems, an object of the present invention is to provide an electronic part in which insulating materials can easily be adhered to lead terminals while the pitch between the terminals remains stable and constant.

In order to achieve the above object, the present invention provides an electronic part comprising lead terminals which extend from an electronic part element unit; and insulating tape adhered to portions of the lead terminals in a vicinity of the unit, said insulating tape being adhered to said lead terminals from both sides such that the tape is placed with the lead terminals therebetween.

The insulating tape can comprise two pieces, and one surface of at least one piece of the tape can be coated with an adhesive.

The lead terminals can be free from insulating coatings.

The electronic part unit can be a thermo-sensitive semiconductor device.

The thermo-sensitive semiconductor device can be either of a positive or negative temperature coefficient thermistor device.

In exemplary embodiments of the present invention, the insulating tape adheres to the lead terminals connected to the electronic part unit, as has been discussed above. With this method of construction, the lead terminals can be insulated.

BRIEF DESCRIPTION OF THE DRAWINGS

The present invention can be further understood with reference to the following description and the appended drawings, wherein like elements are provided with the same reference numerals. In the drawings:

FIG. 1(*a*) is a front view of one embodiment of an electronic part provided with lead terminals according to the present invention;

FIG. 1(*b*) is a cross sectional view of the lead terminals shown in FIG. 1(*a*);

FIG. 2 is a front view illustrating one example of modifications of an electronic part provided with lead terminals according to the present invention;

FIG. 3 is a front view illustrating another example of modifications of an electronic part provided with lead terminals according to the present invention;

DETAILED DESCRIPTION OF THE PREFERRED EMBODIMENTS

Figure 5:
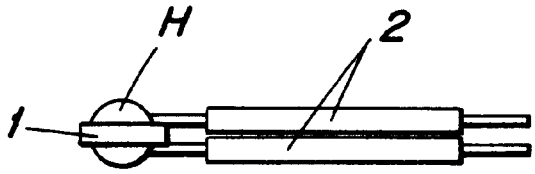
Fig. 5 PRIOR ART
FIG. 5 is a side view illustrating one example of a conventional electronic part.
Figure 6:
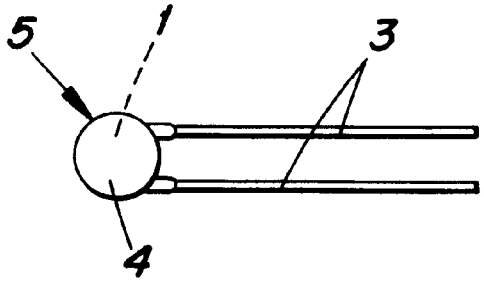
Fig. 6 PRIOR ART
FIG. 6 is a front view illustrating a semi-finished product of another example of a conventional electronic part.
Figure 7:
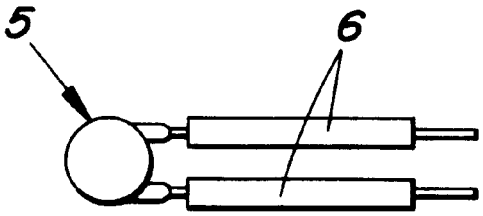
Fig. 7 PRIOR ART
FIG. 7 is a front view illustrating an electronic part obtained by fitting insulating tubes around the semi-finished product shown in FIG. 6.

An exemplary embodiment of the present invention will now be described in detail with reference to FIGS. 1(*a*) and 1(*b*). Elements which are the same as those shown in FIGS. 5–7 are designated by like reference numerals, and an explanation thereof will thus be omitted.

Referring to FIGS. 1(*a*) and 1(*b*), an electronic part 10 is formed by the following process. Two pieces of insulating tape 11, 11 are provided, with one surface of each piece being coated with an adhesive and adhered to portions (for example, non-insulated portions) of lead terminals 3, 3 adjacent to an electronic part element unit 1 of a semi-finished product 5. The two pieces of insulating tape are adhered to the lead terminals 3, 3 from two opposing sides of the lead terminals in such a manner that the tape 11, 11 is placed with the lead terminals 3, 3 therebetween, thereby encasing the circumference of at least a portion of the lead terminals. The lead terminals 3, 3 extend from the electronic part 10 and are formed in parallel to each other, the ends of the terminals 3, 3 being exposed without being covered by the tape 11, 11.

Figure 4:
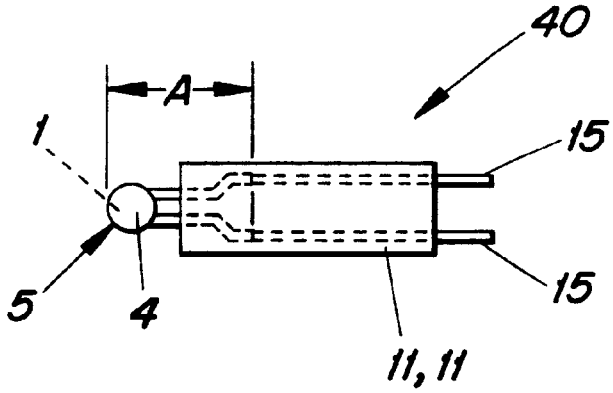
FIG. 4 is a front view illustrating still another example of modifications of an electronic part provided with lead terminals according to the present invention.

FIGS. 2–4 illustrate modifications of the above-described embodiment in which the configuration of the lead terminals 3, 3 of the electronic part 10 is modified. In the exemplary embodiments of FIGS. 2–4, the configuration of the insulating tape 11, 11 is also modified.

Referring to FIG. 2, an electronic part denoted by 20 is formed in such a way that the separation distance of lead terminals 12, 12 of a semi-finished product 5 is tapered in a direction along a length of lead terminals toward the unit so that the ends of terminals 12, 12 can be separated from each other across a predetermined separation distance at a first location relative to the unit. The lead terminals 12, 12 are thus separated by a second separation distance at a second location along their length in a direction toward the unit. The electronic part 20, like the electronic part 10 of the above-described FIG. 1 embodiment, is formed by adhering insulating tape 11, 11 to portions of the lead terminals 12, 12 adjacent to the unit 1 from both sides, in such a manner that the tape 11, 11 is placed with the terminals 12, 12 therebetween.

Referring to FIG. 3, in an electronic part 30, lead terminals 11, 11 are formed with a step configuration so that the ends of lead terminals 13, 13 can be separated from each other across a predetermined distance, as described with respect to the electronic part 20 of FIG. 2. The electronic part 30, as well as the electronic part 10, is formed by adhering insulating tape 14, 14 to portions of the lead terminals 13, 13 adjacent to the unit 1 from both sides, in such a manner that the tape 14, 14 is placed with the terminals 13, 13 therebetween. The adhesive tape 14, 14 adhered to the lead terminals 13, 13 can be formed with a step to match the configuration of the terminals 13, 13.

Referring to FIG. 4, an electronic part 40 is formed in such a way that the space between lead terminals 15, 15 extending from the electronic part element unit 1 is initially narrow, and then broadened at some point. The portions of the lead terminals from the unit 1 to the sections in which the space between the terminals 15, 15 starts to be broadened (indicated by A in FIG. 4), as well as the semi-finished product 5, are each coated with an insulating resin 4. Further, the insulating tape 11, 11 is adhered to portions of the terminals 15, 15, including portions coated with the insulating resin 4, from both sides in such a manner that the tape 11, 11 is placed with the terminals 15, 15 therebetween. Any portions of the lead terminals can be formed with only the insulating resin, only the insulating tape or both the insulating resin and the insulating tape.

For example, if the unit 1 is small and each of the lead terminals has a relatively small diameter, they can easily be deformed. Further, the space between the terminals inevitably becomes narrow, and it is difficult to attach the adhesive tape to the lead terminals, thus increasing the possibility of a short circuit between the terminals. To address these disadvantages, the above-described electronic part 40 can be formed in such a way that the portions A of the terminals 15, 15 which are separated across a narrow space are fixed by the insulating resin, and then, insulating tape is adhered to the portions of the terminals 15, 15 which are separated across a broadened space.

As described above, the electronic part of the present invention makes it unnecessary to solder insulation-coated lead terminals whose ends have been stripped of coatings to the electronic part element unit or to fit insulating tubes around the lead terminals soldered to the unit 1. Exemplary embodiments of the present invention can therefore advantageously decrease the number of manufacturing steps, whereby electronic parts can be efficiently mass-produced.

In accordance with exemplary embodiments, it is only essential that an adhesive is applied to at least one surface of one of the pieces of the insulating tape 11 or 14 adhering to the above-described electronic parts 10, 20, 30 and 40. Alternately, the insulating tape 11 or 14 can, for example, be formed of only one piece; that is, it can be folded over and adhered to the terminals in such a manner that the tape 11 or 14 is placed around the terminals (that is, the terminals are formed therebetween).

As will be clearly understood from the foregoing description, exemplary embodiments of the present invention offer the following advantage. In an electronic part provided with insulation-coated lead terminals according to exemplary embodiments, since the insulating tape is applied to the lead terminals, the pitch between longer lead terminals can remain stable and constant. Additionally, by using a known ceramic capacitor taping manufacturing technique, an easy formation and insulation-coating of the lead terminals can be performed by, for example, attaching lead terminals to the electronic part unit; coating at least a portion of the lead terminals with an insulating resin by means of, for example, immersion; and adhering the insulating tape to the lead terminals.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for producing an electronic part having insulated lead terminals comprising the steps of:

coating at least a first portion of electrical lead terminals of an electronic part unit with an insulating resin; and adhering insulating tape across the lead terminals from two opposing sides of the lead terminals such that said insulating tape encases at least a second portion of said lead terminals, said lead terminals extending out farther from said electronic part than said insulating tape, leaving a distal-most portion of said lead terminals uncovered by said insulating tape;

wherein said insulating tape is adhered to said lead terminals to become a portion of said electronic part in order to insulate said lead terminals; and wherein said coating step is performed before said adhering step.

2. A method according to claim 1, wherein said electronic part is a thermo-sensitive semiconductor device formed with one of a positive temperature coefficient thermistor device and a negative temperature coefficient thermistor device wherein said first portion and said second portion are both formed with said insulating.

3. A method according to claim 1, wherein said step of coating further includes the step of:

immersing said at least a portion of said lead terminals into a resin.

4. A method according to claim 3, further comprising the step of:

forming said lead terminals as first and second lead terminals which extend in parallel from said electronic part unit.

5. A method according to claim 4, wherein said step of forming further includes the step of:

separating said first and second lead terminals from one another by a first distance at a first location along their length, and separating said first and second lead terminals from one another by a second separation distance at a second location along their length.

6. A method according to claim 1, wherein said coating step also comprises coating said electronic part unit.

7. A method according to claim 1, wherein the distance between said lead terminals decreases in a direction toward said electronic part unit.

8. A method according to claim 7, wherein the distance between said lead terminals gradually decreases in a tapered configuration in a direction toward said electronic part unit.

9. A method according to claim 7, wherein the distance between said lead terminals decreases in a step configuration, such that the lead terminals extend in a parallel direction separated by a first distance at a first location along their lengths, and the lead terminals extend in a parallel direction separated by a second distance at a second location along their lengths, the first location being closer to the electronic part unit than said second location, and the first distance being smaller than said second distance.

10. A method according to claim 9, wherein said tape is applied such that it does not encase a section located directly adjacent to said electronic part unit.

11. A method according to claim 10, wherein said resin is applied at least in part to said section which is not to be encased by said tape.

12. A method according to claim 11, wherein said resin is applied such that it also covers said electronic part unit.

13. A method according to claim 12, wherein a portion of said tape overlaps said resin.

14. A method according to claim 13, wherein said tape comprises a single piece of tape which is folded over the lead terminals to encase the lead terminals.

15. A method according to claim 7, wherein said tape is applied such that it does not encase a section located directly adjacent to said electronic part unit.

16. A method according to claim 15, wherein said resin is applied at least in part to said section which is not to be-encased by said tape.

17. A method according to claim 1, wherein said tape is applied such that it does not encase a section located directly adjacent to said electronic part unit.

18. A method according to claim 17, wherein said resin is applied at least in part to said section which is not to be encased by said tape.

19. A method according to claim 1, wherein said tape comprises a single piece of tape which is folded over the lead terminals to encase the lead terminals.

* * * * *